US006016787A

United States Patent [19]

Sakai et al.

[11] Patent Number: 6,016,787

[45] Date of Patent: Jan. 25, 2000

[54] IDLE ROTATION SPEED LEARNING CONTROL APPARATUS AND METHOD OF ENGINE

[75] Inventors: Shoichi Sakai, Atsugi; Takao Kawasaki, Yamato, both of Japan

[73] Assignees: Unisia Jecs Corporation, Atsugi; Nissan Motor Company, Ltd., Yokohama, both of Japan

[21] Appl. No.: 09/109,095

[22] Filed: Jul. 2, 1998

[30] Foreign Application Priority Data

Jul. 4, 1997 [JP] Japan ..... 9-179681

[51] Int. Cl.[7] ..... F02D 3/00; F02M 3/00

[52] U.S. Cl. ..... 123/339.12

[58] Field of Search ..... 123/339.12, 339.1, 123/339.19, 339.23

[56] References Cited

U.S. PATENT DOCUMENTS

| | | | |
|---|---|---|---|
| 4,602,601 | 7/1986 | Kanai | 123/339.12 |
| 4,715,344 | 12/1987 | Tomisawa | 123/339.12 |
| 5,018,494 | 5/1991 | Sonoda et al. | 123/339.12 |
| 5,228,421 | 7/1993 | Orzel | 123/339.12 |
| 5,839,410 | 11/1998 | Suzuki et al. | 123/339.12 |

*Primary Examiner*—Erick R. Solis
*Attorney, Agent, or Firm*—Foley & Lardner

[57] ABSTRACT

In an engine whose target air-fuel ratio during the idle state is set to a leaner value than a theoretical air-fuel ratio, the target air-fuel ratio is forcibly switched to the theoretical air-fuel ratio and the learning is performed, when learning a learning correction quantity of the idle rotation speed, and the learning performed by switching to said theoretical air-fuel ratio is executed only once during an on state of an ignition switch.

12 Claims, 4 Drawing Sheets

IDLE ROTATION SPEED LEARNING CONTROL APPARATUS AND METHOD OF ENGINE

BACKGROUND OF THE INVENTION (1) Field of the Invention

The present invention relates to an idle rotation speed learning control apparatus and method of an engine, more specifically to an apparatus for controlling an intake air quantity of the engine so that the engine rotation speed when driven in an idle state becomes a target idle rotation speed, and especially to a technique for learning and correcting the portion corresponding to the decreasingly changed portion of an opening area by age of the engine intake system caused by fouling, clogging and the like.

(2) Related Art of the Invention

Conventionally, in the engines mounted in vehicles an engine intake air quantity is feedback controlled during the idle driving of the engine, so that an engine rotation speed approximates a target idle rotation speed.

Moreover, when a predetermined learning condition is fulfilled, the feedback correction quantity for gaining the target idle rotation speed is learned as a decreasingly changed portion of the opening area by age of the intake system caused by fouling and clogging.

In recent years, a lean burn engine performing the combustion by an air-fuel ratio of approximately 20 to 25, or a direct injection gasoline engine is developed which enables combustion by a super lean air-fuel ratio of approximately 40 to 50 by performing a stratified combustion where fuel is injected directly into a cylinder.

In such engines, the improvement of the fuel consumption and the exhaust emission are attempted by performing a lean burn during a low rotation or a low load region including the idle state. Therefore, when applying the conventional idle rotation speed learning control as it is to the lean burn engine or the direct injection gasoline engine, the learning will be performed in a lean burn state.

However, when combustion is performed in a lean air-fuel ratio, the request intake air quantity of the engine will be large in comparison to the case where combustion is performed in a theoretical air-fuel ratio. Therefore, the ratio of the decreasingly changed portion of the air quantity caused by fouling and clogging in the whole intake air quantity is relatively small. Therefore, in a structure where the learning of the idle rotation speed is performed in a lean burn state, there was a problem that a highly accurate learning of the decreasingly changed portion of the opening area caused by fouling and clogging is difficult.

SUMMARY OF THE INVENTION

The present invention focuses on the above mentioned problems, and it aims at performing, in an engine of a lean burn engine or a direct injection gasoline engine in which an air-fuel ratio during an idle state is controlled to be leaner than the theoretical air-fuel ratio, the learning on the decreasingly changed portion of the opening area caused by fouling and clogging at a high accuracy.

Further object of the present invention is to perform an accurate learning of the idle rotation speed by making effort not to reduce the improvement effect of the fuel consumption and the exhaust emission during a lean burn in a lean burn engine or a direct injection gasoline engine.

In order to achieve the above object, the idle rotation speed leaning control apparatus and method of an engine according to the present invention is constructed so as to prohibit the combustion at a lean air-fuel ratio and to set the target air-fuel ratio forcibly to a theoretical air-fuel ratio when performing the learning of the decreasingly changed portion of the opening area.

According to such a construction, even during the idle driving of the engine where the air-fuel ratio should essentially be controlled to a comparably lean air-fuel ratio than the theoretical air-fuel ratio, the combustion is performed at a theoretical air-fuel ratio when learning the decreasingly changed portion of the opening area. In other words, the air-fuel ratio is switched from a lean air-fuel ratio to a theoretical air-fuel ratio in order to decrease the intake air quantity of the engine during the learning, so that the ratio of the reduced portion of the intake air quantity caused by fouling and clogging is relatively increased in the whole intake air quantity.

The control of the intake air quantity in the idle state is performed in detail as follows. When the engine is idling, in order to approximate the engine rotation speed to the target idle rotation speed, a feedback correction quantity for adjusting the engine intake air quantity is set, and on the other hand, judgment of the learning condition is performed for learning the decreasingly changed portion of the opening area by age in the intake system of the engine, and when the fulfillment of the learning condition is distinguished, a learning correction quantity corresponding to the decreasingly changed portion of the opening area is learned based on the feedback correction quantity, and the intake air quantity of the engine is controlled based on the feedback correction quantity and the learning correction quantity. Then, when the fulfillment of the learning condition is distinguished, then the combustion in the lean air-fuel ratio is prohibited, and the target air-fuel ratio is set forcibly to the theoretical air-fuel ratio.

According to such a construction, when the fulfillment of the learning condition is distinguished, the target air-fuel ratio is changed forcibly from the lean air-fuel ratio to the theoretical air-fuel ratio, and from the feedback correction quantity in the state where combustion is performed by the theoretical air-fuel ratio, the decreasingly changed portion of the opening area is learned as a learning correction quantity. Then, based on the feedback correction quantity and the learning correction quantity, the intake air quantity of the engine is controlled, thereby gaining the target idle rotation speed.

Further, it is better to limit the execution of the control for setting the target air-fuel ratio forcibly to the theoretical air-fuel ratio within a previously set learning frequency.

According to such a construction, the control for performing the combustion forcibly in a theoretical air-fuel ratio for learning will not be repeated unconditionally, but rather, limited to a previously set learning frequency. Therefore, even if the learning condition is fulfilled, if it exceeds a predetermined learning frequency, no learning accompanying the forcible switching from the lean burn to the theoretical air-fuel ratio will be performed.

Moreover, the previously set learning frequency can be set to a ratio of one time during every "on" state of the ignition switch.

According to such a construction, when the learning is performed by setting the air-fuel ratio forcibly to the theoretical air-fuel ratio for even once after the ignition switch is turned on, then the air-fuel ratio will not be changed forcibly again to the theoretical air-fuel ratio thereafter even when the learning condition is fulfilled, which means that no learning will be performed.

Further, the previously set learning frequency can be set to a ratio of once in every state where the learning condition is fulfilled continuously for more than a predetermined time.

According to such a construction, learning will not be performed by setting the air-fuel ratio to the theoretical air-fuel ratio directly after the learning condition is fulfilled, but rather, the learning is performed by setting the air-fuel ratio to the theoretical air-fuel ratio after a predetermined time had passed with the learning condition being fulfilled continuously. Accordingly, even when the learning condition is fulfilled, no learning by switching the air-fuel ratio will be performed when the learning condition only continues for a short time.

On the other hand, it is preferable to distinguish the idle driving state of the engine, the completion of warming up, and the non-makeup state of the accessory load as the learning condition.

According to such a construction, the decreasingly changed portion of the opening area by age in the intake system of the engine can be learned without being influenced by the difference in the request air quantity according to the accessory load or the friction of the engine.

These and other objects and phases of the present invention will be made clear from the following description on the preferred embodiments regarding the accompanied drawings.

DETAILED DESCRIPTION OF THE PREFERRED EMBODIMENT

The preferred embodiments of the present invention will be explained below.

Figure 1:
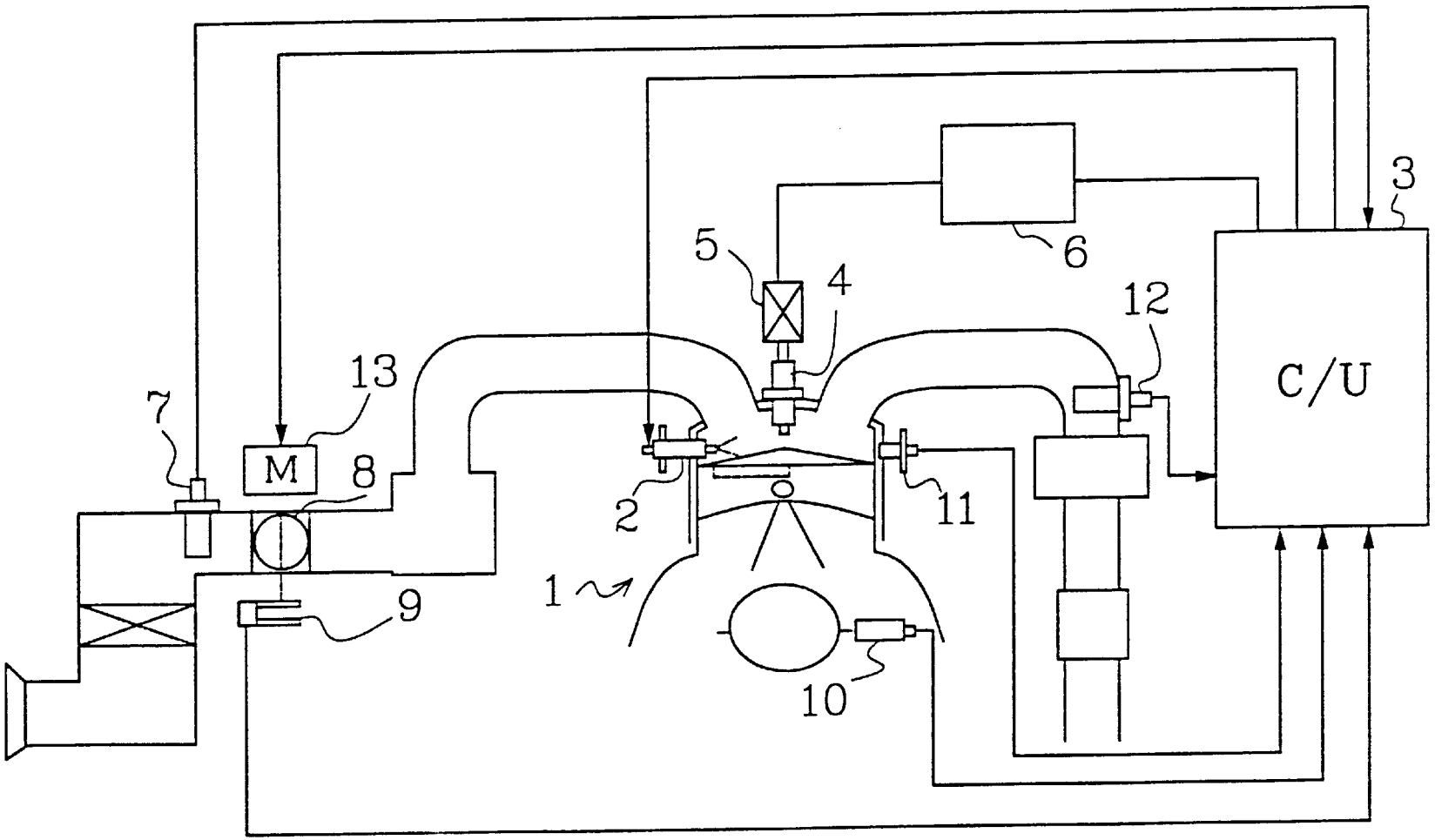
FIG. 1 shows the system composition of the engine according to the embodiment of the present invention.

FIG. 1 is a system component view of an engine according to the present embodiment, and an engine 1 shown in FIG. 1 is a direct injection gasoline engine comprising a fuel injection valve 2 equipped on each cylinder for directly injecting fuel into the cylinder, and an ignition plug 4 equipped on each cylinder.

The fuel injection valve 2 is controlled separately for each cylinder by an injection pulse signal transmitted from a control unit 3 installing a microcomputer. Further, to each ignition plug 4 is equipped an ignition coil 5, and in response to an ignition signal from the control unit 3, the power to the primary side of each ignition coil 5 is turned on or off by a power transmission unit 6, thereby controlling the ignition timing for each cylinder.

Detection signals from various sensors are inputted to the control unit 3 for the control of fuel injection timing and ignition timing.

As various sensors, there is provided sensors such as an airflow meter 7 for detecting the intake airflow, a throttle sensor 9 for detecting the opening of a throttle valve 8 which is electrically controlled to open and close by a motor 13, a crank angle sensor 10 for detecting the crank angle, a water temperature sensor 11 for detecting the cooling water temperature, and an oxygen sensor 12 for detecting the average air-fuel ratio of the combustion mixture based on the oxygen concentration in the exhaust gas.

On the other hand, the control unit 3 comprises a plurality of target equivalence ratio maps setting in advance the target equivalence ratio (target air-fuel ratio) and the combustion mode corresponding to the target output torque and the engine rotation speed. The plurality of target equivalence ratio maps are switched in correspondence to conditions such as the water temperature, the time after starting, the vehicle speed, the acceleration and the like for reference, and the control unit 3 distinguishes the request on the combustion mode and the target equivalence ratio. Accordingly, the fuel injection quantity and the injection timing by the fuel injection valve 2 is controlled.

A homogenized combustion mode for performing homogenized combustion by injecting fuel during the intake stroke and a stratified combustion mode for performing stratified lean burn by forming a concentrated air-fuel mixture to the area approximate to the ignition plug 4 by injecting fuel during the compression stroke are set as the combustion modes, and in the homogenized combustion mode, the target equivalence ratio is controlled to lean, stoichiometric ratio (theoretical air-fuel ratio) or rich according to the driving region. Further, in a low load and low rotation region including the idle condition, the combustion mode is set either to the stratified combustion mode (stratified lean burn) or the homogenized lean burn, excluding the initiation time.

Moreover, the control unit 3 determines a basic control signal of the motor 13 in order to gain a target idle rotation speed during the idle driving time, and corrects the basic control signal by a feedback correction quantity so that the engine rotation speed approximates the target idle rotation speed. The corrected control signal is output to the motor 13, thereby controlling the opening of the throttle valve 8. Such functions of the control unit 3 correspond to a feedback correction quantity setting device.

Further, the control unit 3 is set to learn the decrease in portion of the intake air quantity gained against an opening, which is caused by the decrease in the opening area by age of the opening caused by fouling and the like of the throttle valve 8. Based on the learning correction quantity being gained by the learning, and the correction quantity being gained by the feedback control, the control signal to be transmitted to the motor 13 will be determine. Therefore, the control unit 3 also holds the function as an idle rotation speed learning control device, an idle learning device, and an air quantity control device.

The first embodiment of the learning control will now be explained.

Figure 2:
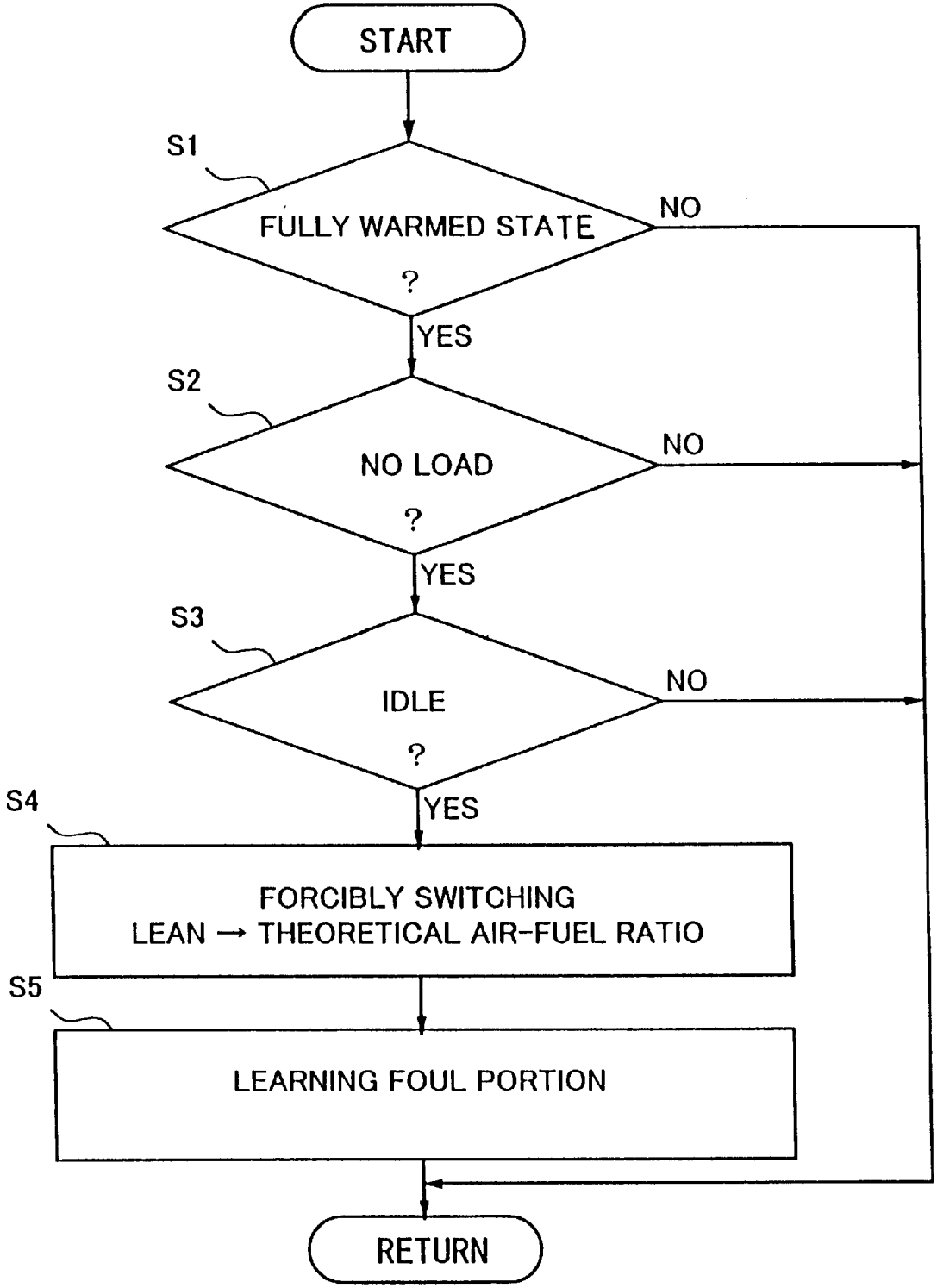
FIG. 2 is a flowchart showing a first embodiment of the learning control regarding the idle rotation speed.

According to the flowchart of FIG. 2 showing the first embodiment, in step S1, judgment is made on whether the engine is fully warmed or not based on the cooling water temperature being detected by the water temperature sensor 11.

When the engine is in a fully warmed state, procedure is advanced to step S2, where judgment is made on whether or not exterior loads (accessory loads) are not made. Actually, when the air conditioner is off, and the electric loads of N range, head lights and the like are off, then judgment is made that external loads are in a non-makeup state (no-load state).

When the external load is in a non-makeup state, procedure is advanced to step S3, where judgment is made on whether or not the engine is in an idle driving state where the feedback control to the target idle rotation speed is performed.

When it is judged that the engine is idle in step S3, that is, when the engine is in a fully warmed state, the external load is in a non-makeup state, and the engine is in an idle state, judgment is made that the learning condition is fulfilled, and procedure is advanced to step S4.

The steps S1 through S3 correspond to the learning condition judgment device.

In step S4, the combustion state set either to the homogenized lean or the stratified lean by the target equivalence ratio map is switched forcibly to the homogenized combustion mode setting the target equivalence ratio to the theoretical air-fuel ratio. This portion corresponds to the lean burn prohibition device.

By performing the forcible switching from the lean air-fuel ratio to the theoretical air-fuel ratio, the intake air quantity of the engine will be reduced. Thereby, the ratio of the decreased portion in the air quantity due to fouling and clogging in the whole intake air quantity becomes large, and the learning accuracy will be improved.

When the switching to the theoretical air-fuel ratio has been performed and the combustion state has stabilized, procedure is advanced to step S5, where the average value of the feedback correction quantity at that time is calculated, and the weighted average value of the average value and the learning correction quantity is renewingly memorized as a new learning correction quantity (idle learning device).

In a construction where the leaning is performed by switching from a lean burn state to a theoretical air-fuel ratio every time the learning condition is fulfilled, the chances of learning the progression of fouling or clogging may be excessive, and by the switching to the theoretical air-fuel ratio which is performed every time the learning is carried out, the fuel consumption and the exhaust emission will be deteriorated.

Figure 3:
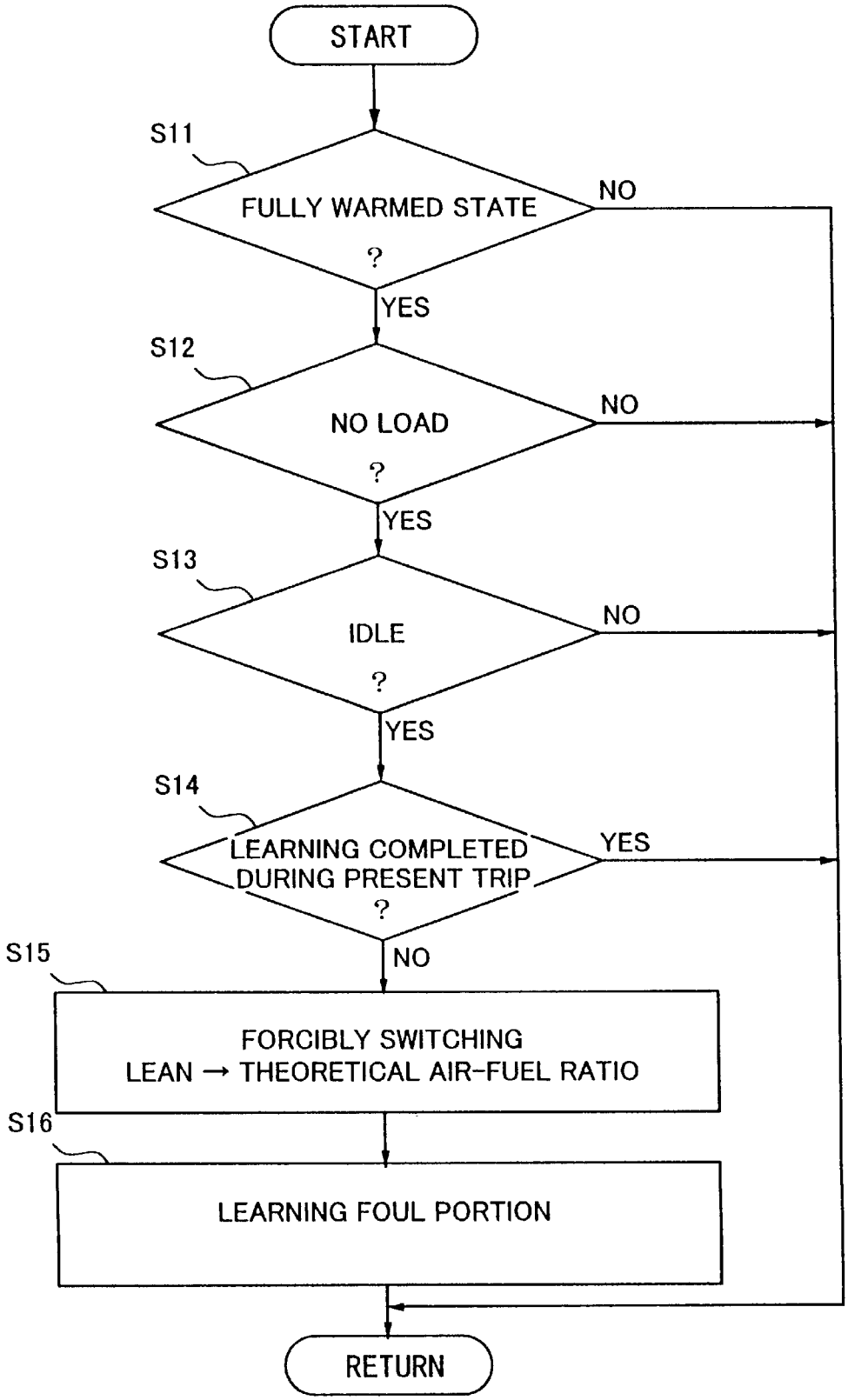
FIG. 3 is a flowchart showing a second embodiment of the learning control regarding the idle rotation speed.

Therefore, according to the second embodiment of the present invention shown in FIG. 3, it is preferable to limit the learning within a previously set learning frequency.

In the flowchart of FIG. 3, the judgment on whether the learning condition is fulfilled or not is performed by steps S11 through S13, similar to the steps S1 through S3 explained above.

When it is judged that the learning condition is fulfilled, then procedure is advanced to step S14, where judgment is made on whether the learning was performed during the present trip for even once.

The term trip refers to the period of time from the turning on of the ignition switch to the turning off of the same. Therefore, the judgment performed in step S14 is on whether the learning has been performed for even once after the ignition switch had been switched on.

If it is judged that learning has finished in step S14, then the present routine is terminated by detouring steps S15 and S16, and no switching to the theoretical air-fuel ratio or no leaning is performed. Thereby, the leaning in one trip will be limited to only once. The portion explained above of step S14 corresponds to the learning frequency limiting device.

On the other hand, when no learning has been performed, then procedure is advanced to step S15, where the forcible switching from the lean to the theoretical air-fuel ratio is performed. Then in the following step S16, the feedback correction quantity at that time will be learned as the decreased portion of the air quantity (decreasingly changed portion of the opening area) caused by fouling and clogging.

Further, the above description explained the case where the learning frequency is limited to once in every one trip. However, the learning frequency can also be limited by performing the learning for the first time after a predetermined time has passed where the learning condition has continued to be fulfilled. This is the third embodiment of the present invention which is shown by the flowchart of FIG. 4.

Figure 4:
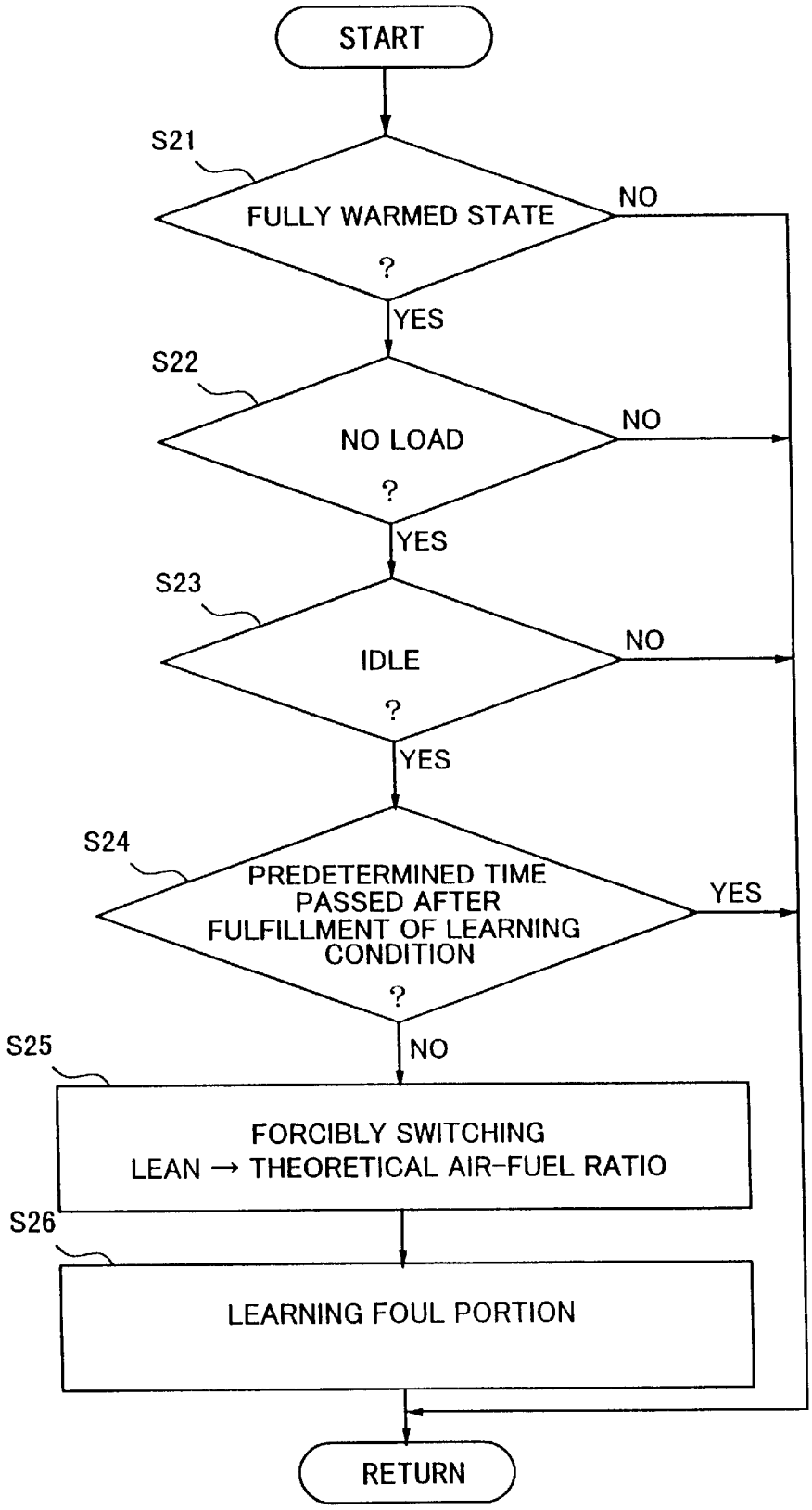
FIG. 4 is a flowchart showing a third embodiment of the learning control regarding the idle rotation speed.

According to the flowchart of FIG. 4, steps S21 through S23 perform the judgment on whether the learning condition is fulfilled or not, similar to steps S1 through S3 explained above.

When the fulfillment of the learning condition is judged, procedure is advanced to step S24, where judgment is made on whether the learning condition has continuously fulfilled for more than a predetermined time.

If the learning condition has fulfilled but the continuous time of fulfillment falls short of the predetermined time, steps S25 and S26 are detoured to terminate the present routine. Therefore, in the case where the learning condition is fulfilled but only for a short time, then no learning will be performed, and the chance of learning will be limited to when the learning condition is fulfilled for a longer period of time. The portion of step S24 correspond to the learning frequency limiting device.

On the other hand, when it is judged in step S24 that the learning condition has been maintained for more than a predetermined period of time, then procedure is advanced to step S25, where forcible switching from the lean to the theoretical air-fuel ratio will be performed. In the following step S26, the feedback correction quantity at that time is learned as the decreased portion of the air quantity (decreasingly changed portion of the opening area) caused by fouling and clogging.

In the above-explained embodiment, the learning condition was set to the state where the engine is fully warmed, the exterior load is in a non-makeup state, and the engine is in an idle state. However, the learning condition should not be limited to the above.

Further, the present invention can be equipped with an assistance air passage for bypassing the throttle valve, and an idle control valve to be mounted on the assistance air passage, wherein the opening of the idle control valve is controlled so as to control the speed to the target idle rotation speed.

Moreover, the present engine should not be limited to a direct injection gasoline engine, but it can be a lean burn engine comprising a fuel injection valve mounted on an intake port, and performing the combustion by a leaner air-fuel ratio than the theoretical air-fuel ratio in the low load and low rotation region including at least the idle state.

What we claimed are:

1. An idle rotation speed learning control apparatus of an engine in which a target air-fuel ratio is set to a leaner value than a theoretical air-fuel ratio in a predetermined driving region including at least an idle state, the apparatus comprising:

an idle rotation speed learning control means for learning a decreasingly changed portion of an opening area by age in an intake system of the engine based on the result of performing a feedback control of an intake air quantity of said engine so as to approximate an engine rotation speed to a target idle rotation speed during an idle drive, and in response to said learned results, controlling the intake air quantity during said idle drive; and a lean burn prohibition means for prohibiting the combustion in said lean air-fuel ratio and setting said target air-fuel ratio forcibly to said theoretical air-fuel ratio when the learning by said idle rotation speed learning control means is performed.

2. An idle rotation speed learning control apparatus of an engine according to claim 1;

wherein said idle rotation speed learning control means comprises:

a feedback correction quantity setting means for setting a feedback correction quantity for adjusting the engine intake air quantity so as to approximate said engine rotation speed to said target idle rotation speed during said idle driving of the engine;

a learning condition judgment means for judging a learning condition for learning said decreasingly changed portion of the opening area by age of the engine intake system;

an idle learning means for learning a learning correction quantity corresponding to said decreasingly changed portion of the opening area based on said feedback correction quantity set by said feedback correction quantity setting means when the fulfillment of said learning condition is judged by said learning condition judgment means; and an air quantity control means for controlling the intake air quantity of said engine based on said feedback correction quantity and said learning correction quantity;

and wherein said lean burn prohibition means is characterized in prohibiting the combustion is said lean air-fuel ratio and forcibly setting said target air-fuel ratio to said theoretical air-fuel ratio when the fulfillment of said learning condition is judged by said learning condition judgment means.

3. An idle rotation speed learning control apparatus of an engine according to claim 1, wherein a learning frequency limiting means is further equipped for limiting the execution of the control for forcibly setting said target air-fuel ratio to said theoretical air-fuel ratio by said lean burn prohibition means within a previously set learning frequency.

4. An idle rotation speed learning control apparatus of an engine according to claim 3, wherein said previously set learning frequency is a ratio of once during every on state of the ignition switch.

5. An idle rotation speed learning control apparatus of an engine according to claim 3, wherein said previously set learning frequency is a ratio of once in every state where said learning condition is fulfilled continuously for more than a predetermined time.

6. An idle learning control apparatus of an engine according to claim 2, wherein said learning control judgment means judges as said learning condition the idle drive state of the engine, the completion of warm-up of the engine, and the non-makeup state of an accessory load.

7. An idle rotation speed learning control method of an engine in which a target air-fuel ratio is set to a leaner value than a theoretical air-fuel ratio at least in a predetermined driving region including an idle drive; the method comprising:

learning a decreasingly changed portion of an opening area by age of an engine intake system based on the result of performing a feedback control of an intake air quantity of the engine so as to approximate an engine rotation speed to a target idle rotation speed during the idle drive, controlling said intake air quantity of the engine during the idle drive in response to the learned results, and on the other hand, prohibiting the combustion in said lean air-fuel ratio and setting said target air-fuel ratio forcibly to said theoretical air-fuel during said learning.

8. An idle rotation speed learning control method of an engine according to claim 7, wherein said control of the intake air quantity during said idle drive comprises:

a step of setting a feedback correction quantity for adjusting said engine intake air quantity so as to approximate said engine rotation speed to said target idle rotation speed during the idle drive of the engine;

a step of judging a learning condition for learning said decreasingly changed portion of the opening area by age in the engine intake system;

a step of learning a learning correction quantity corresponding to said decreasingly changed portion of the opening area based on said feedback correction quantity when fulfillment of the learning condition has been distinguished; and a step of controlling said engine intake air quantity based on said feedback correction quantity and said learning correction quantity; wherein the combustion in said lean air-fuel ratio is prohibited and said target air-fuel ratio is forcibly set to said theoretical air-fuel ratio when fulfillment of said learning condition is distinguished.

9. An idle rotation speed learning control method of an engine according to claim 7, wherein the execution of the control for forcibly setting said target air-fuel ratio to said theoretical air-fuel ratio is limited within a previously set learning frequency.

10. An idle rotation speed learning control method of an engine according to claim 9, wherein said previously set learning frequency is a ratio of once during every on-state of the ignition switch.

11. An idle rotation speed learning control method of an engine according to claim 9, wherein said previously set learning frequency is a ratio of once in every state where said learning condition is fulfilled continuously for more than a predetermined time.

12. An idle rotation speed learning control method of an engine according to claim 8, wherein the idle drive state of the engine, the completion of warm-up of the engine, and the non-makeup state of an accessory load are judged as said learning condition.

* * * * *